US007429302B2

(12) United States Patent
Hirasawa et al.

(10) Patent No.: US 7,429,302 B2
(45) Date of Patent: Sep. 30, 2008

(54) STAINLESS STEEL SHEET FOR WELDED STRUCTURAL COMPONENTS AND METHOD FOR MAKING THE SAME

(75) Inventors: Junichiro Hirasawa, Chiba (JP); Takumi Ujiro, Chiba (JP); Osamu Furukimi, Chiba (JP)

(73) Assignee: JFE Steel Corporation (JP)

( * ) Notice: Subject to any disclaimer, the term of this patent is extended or adjusted under 35 U.S.C. 154(b) by 12 days.

(21) Appl. No.: 10/395,475

(22) Filed: Mar. 24, 2003

(65) Prior Publication Data

US 2003/0188813 A1 Oct. 9, 2003

(30) Foreign Application Priority Data

Mar. 28, 2002 (JP) ..... 2002-091877
Nov. 8, 2002 (JP) ..... 2002-325448

(51) Int. Cl.
*C22C 38/40* (2006.01)
*C21D 8/02* (2006.01)

(52) U.S. Cl. ..... 148/325; 148/505; 148/506; 148/534; 148/608; 148/609; 148/610; 148/651; 148/653; 420/34; 428/682

(58) Field of Classification Search ..... 148/325, 148/609, 610, 608, 505, 506, 534, 651, 653; 420/34; 428/682
See application file for complete search history.

(56) References Cited

U.S. PATENT DOCUMENTS 4,067,754 A * 1/1978 Elias et al. ..... 148/531
4,331,474 A 5/1982 Espy
4,437,902 A * 3/1984 Pickens et al. ..... 148/521
6,786,981 B2 * 9/2004 Yazawa et al. ..... 148/325

FOREIGN PATENT DOCUMENTS

EP 0 774 520 A1 5/1997
EP 1 070 763 A1 1/2001
EP 1 160 347 A1 12/2001
JP 10204587 8/1998

OTHER PUBLICATIONS

"Stainless Steel Handbook: Reference Manual 1," Jan. 24, 1995, pp. 102-104 with English translation.

* cited by examiner

*Primary Examiner*—Deborah Yee
(74) *Attorney, Agent, or Firm*—DLA Piper US LLP

(57) ABSTRACT

A structural hot-rolled or cold-rolled stainless steel sheet having improved intergranular corrosion resistance and toughness at the welding heat affected zone and further having low strength and high elongation. The composition of the steel sheet contains less than about 0.008 mass percent of C; about 1.0 mass percent or less of Si; about 1.5 mass percent or less of Mn; about 11 to about 15 mass percent of Cr; more than about 1.0 mass percent and about 2.5 mass percent or less of Ni; less than about 0.10 mass percent of Al; about 0.009 mass percent or less of N; about 0.04 mass percent or less of P; about 0.01 mass percent or less of S; and the balance being Fe and incidental impurities. These contents satisfy the expressions: $(Cr)+1.2\times(Ni)\geqq 15.0$; $(Ni)+0.5\times(Mn)+30\times(C)\leqq 3.0$; $(C)+(N)\leqq 0.015$; and $(Cr)-(Mn)-1.7\times(Ni)-27\times(C)-100\times(N)\geqq 9.0$.

52 Claims, 3 Drawing Sheets

STAINLESS STEEL SHEET FOR WELDED STRUCTURAL COMPONENTS AND METHOD FOR MAKING THE SAME

BACKGROUND

1. Field of the Invention

This invention relates to a stainless steel sheet for welded structural components having excellent intergranular corrosion resistance and workability and which is, therefore, suitably used for vehicle structural components such as railway vehicles, automobiles, and buses, and civil engineering structural components which often undergo welding and bending and are required to have corrosion resistance.

2. Description of the Related Art

Structural components of vehicles, for example, railway vehicles, must have high corrosion resistance to maintain cosmetic appearance and to prevent a decrease in strength resulting from thickness reduction due to corrosion. Accordingly, austenitic stainless steel sheets, such as SUS301L and SUS304 specified in Japanese Industrial Standards (JIS), have been used for these structural components. The austenitic stainless steel sheets have excellent workability and toughness at the weld zone. However, when vehicles are manufactured, weld zones can be sensitized to cause intergranular corrosion, as shown in The 89th Corrosion Control Symposium Materials, "Case Study Method—Cases of Corrosion of Stainless Railway Vehicles", pp. 84-91, Mar. 19, 1992, wherein "sensitized" means that, when a steel sheet is heated to high temperature, chromium carbide ($Cr_{23}C_6$) is produced at grain boundaries and, thus, a Cr depletion layer is formed around the chromium carbide. As for ferritic stainless steels, such as SUS430 specified in JIS, the grains become larger at the weld zone and, thus, the toughness at the weld zone decreases. In addition, chromium carbonitrides are precipitated in the coarse grain boundaries of the stainless steel to cause intergranular corrosion.

Martensitic stainless steel sheets for welded structural components, as epitomized by SUS410 specified in JIS, are suitably used to prevent intergranular corrosion because they are not significantly sensitized. However, since the martensitic stainless steels have a Cr content of about 12 mass percent, among the lowest in stainless steels and do not contain Ni and Mo, which enhance corrosion resistance, the corrosion resistance thereof is low and is not, therefore, satisfactory for use in parts exposed to observation.

Relating to these problems, Japanese Unexamined Patent Application Publication No. 11-302795 has disclosed an inexpensive stainless steel for general building structural components, having excellent corrosion resistance in housing conditions, weldability, and properties at the weld zone. The stainless steel is made by forming at least 50% by volume of martensitic structures in the welding heat affected zone (the region where the base material is not welded, but the hardness and structure thereof are changed by welding heat) and by refining the crystal grains to enhance the toughness. However, when martensitic structures are produced at the grain boundaries in the welding heat affected zone, the martensitic structures may be selectively corroded in some conditions to seriously degrade the intergranular corrosion resistance in the welding heat-affected zone. Thus, intergranular fracture may be caused by the corrosion. Highly corrosion-resistant martensitic stainless steels used for oil well pipes and pipelines generally contain 3 mass percent or more of Ni and, accordingly, have excellent corrosion resistance. The Ni, however, increases the resistance to anneal softening, so that the resulting structure after annealing is not a ferrite single-phase structure but contains martensitic structures, thereby increasing the strength to 800 MPa or more. Unfortunately, the highly corrosion-resistant martensitic stainless steels are not suitable for use in vehicle structural components and civil engineering structural components which often undergo bending.

No types of steel have been developed which has satisfactory resistance and workability in base material and satisfactory intergranular corrosion resistance and toughness at the weld zone.

It would accordingly be advantageous to provide a structural stainless steel sheet having remarkably enhanced intergranular corrosion resistance and excellent toughness at the welding heat affected zone, and further having, excellent workability with low strength and high elongation, and to provide a method for making the same.

SUMMARY OF THE INVENTION

This invention is directed to a stainless steel sheet and a method for making the same which comprises less than about 0.008 mass percent of C; about 1.0 mass percent or less of Si; about 1.5 mass percent or less of Mn; about 11 to about 15 mass percent of Cr; more than about 1.0 mass percent and about 2.5 mass percent or less of Ni; less than about 0.10 mass percent of Al; about 0.009 mass percent or less of N; about 0.04 mass percent or less of P; about 0.01 mass percent or less of S; and the balance being Fe and incidental impurities. These contents satisfy expressions (1) to (4):

$$(Cr)+1.2\times(Ni)\geqq 15.0 \quad (1)$$

$$(Ni)+0.5\times(Mn)+30\times(C)\leqq 3.0 \quad (2)$$

$$(C)+(N)\leqq 0.015 \quad (3)$$

$$(Cr)-(Mn)-1.7\times(Ni)-27\times(C)-100\times(N)\geqq 9.0 \quad (4)$$

where (Cr), (Ni), (Mn), (C), and (N) represent Cr, Ni, Mn, C, and N contents on a mass percent basis, respectively. The stainless steel sheet may be a hot-rolled steel sheet or a cold-rolled steel sheet.

Also, the invention is directed to another stainless steel sheet and a method for making the same which comprises about 2.0 mass percent or less of Mo in addition to the composition of the foregoing stainless steel sheet, and in which expressions (3), (5), (6), and (7) are satisfied, instead of expressions (1) to (4):

$$(C)+(N)\leqq 0.015 \quad (3)$$

$$(Cr)+1.2\times(Ni)+1.5\times(Mo)\geqq 15.0 \quad (5)$$

$$(Ni)+0.5\times((Mn)+(Mo))+30\times(C)\leqq 3.0 \quad (6)$$

$$(Cr)+0.8\times(Mo)-(Mn)-1.7\times(Ni)-27\times(C)-100\times(N)\geqq 9.0 \quad (7)$$

where (Cr), (Mo), (Ni), (Mn), (C), and (N) represent Cr, Mo, Ni, Mn, C, and N contents on a mass percent basis, respectively. This stainless steel sheet may be a hot-rolled steel sheet or a cold-rolled steel sheet.

The invention is also directed to still another stainless steel sheet and a method for making the same which comprises at least one of about 2 mass percent or less of Cu and about 2 mass percent or less of Co in addition to one of the compositions of the foregoing stainless steel sheets. When the stainless steel sheet contains at least one of Cu and Co, expressions (3), (8), (9), and (10) are satisfied, instead of expressions (1) to (7):

$$(C)+(N) \leqq 0.015 \quad (3)$$

$$(Cr)+1.2\times(Ni)+0.5\times(Cu)+0.3\times(Co) \geqq 15.0 \quad (8)$$

$$(Ni)+0.5\times((Mn)+(Cu))+30\times(C) \leqq 3.0 \quad (9)$$

$$(Cr)-(Mn)-1.7\times(Ni)-27\times(C)-100\times(N)-0.3\times(Cu) \geqq 9.0 \quad (10)$$

When the stainless steel sheet contains Mo and at least one of Cu and Co, expressions (3), (11), (12), and (13) are satisfied, instead of expressions (1) to (7):

$$(C)+(N) \leqq 0.015 \quad (3)$$

$$(Cr)+1.2\times(Ni)+1.5\times(Mo)+0.5\times(Cu)+0.3\times(Co) \geqq 15.0 \quad (11)$$

$$(Ni)+0.5\times((Mn)+(Mo)+(Cu))+30\times(C) \leqq 3.0 \quad (12)$$

$$(Cr)+0.8\times(Mo)-(Mn)-1.7\times(Ni)-27\times(C)-100\times(N)-0.3\times(Cu) \geqq 9.0 \quad (13)$$

In these expressions, (Cr), (Mo), (Ni), (Mn), (Cu), (Co), (C), and (N) represent Cr, Mo, Ni, Mn, Cu, Co, C, and N contents on a mass percent basis, respectively. This stainless steel sheet may also be a hot-rolled steel sheet or a cold-rolled steel sheet.

The stainless steel sheet of the invention may further comprise at least one of about 0.0050 mass percent or less of B and about 0.0050 mass percent or less of Ca.

The stainless steel sheet may further comprise at least one component selected from the group consisting of about 0.2 mass percent or less of Ti, about 0.2 mass percent or less of Nb, about 0.2 mass percent or less of V, about 0.2 mass percent or less of Zr, and about 0.2 mass percent or less of Ta.

The stainless steel sheet may further comprise at least one of about 0.10 mass percent or less of W and about 0.01 mass percent or less of Mg.

Preferably, the stainless steel sheet has a tensile strength of about 600 MPa or less and is used for welded structural components.

In the stainless steel sheet, preferably, the volume percentage of the martensitic structure produced in the welding heat affected zone is less than about 5 percent, and the Charpy impact value of the welding heat affected zone is about 30 $J/cm^2$ or more at −50° C.

DETAILED DESCRIPTION

Figure 1:
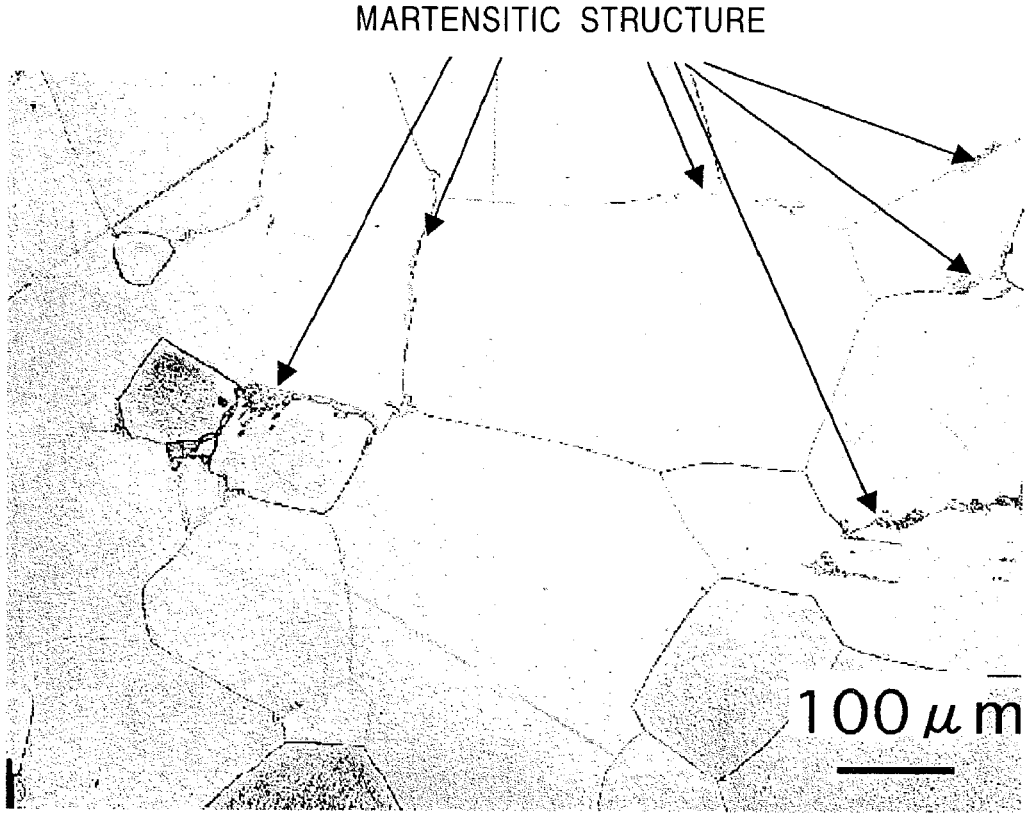
FIG. 1 is a micrograph of a metal structure containing 2 volume % of martensitic structures.

We investigated the composition of stainless steels as to effects on the corrosion resistance and mechanical properties of the base material and the intergranular corrosion resistance and toughness at the weld zones in detail to provide a structural stainless steel sheet having excellent toughness at the welding heat affected zone and excellent workability with low strength and high elongation and a method for making the same. As a result, we found the following: (1) corrosion resistance is remarkably enhanced by adding Cr and Ni (and, if necessary, Mo, Cu, and Co); (2) a low strength of about 600 MPa or less and a high elongation are obtained by limiting the contents of Ni, Mn, and C (and, if necessary, the Mo and Cu contents), which suppress ferritic transformation, to reduce the resistance to anneal softening so that the metal structure after annealing essentially consists of ferrite and carbide, but does not contain martensitic structures; (3) excellent intergranular corrosion resistance and toughness are substantially simultaneously achieved by significantly reducing the C and N contents to be C+N≦0.015 mass percent; and (4) adjusting the Cr, Mn, Ni, C, and N (and, if necessary, Mo and Cu) contents so that the amount of martensite produced at the welding heat affected zone is limited to less than about 5 percent by volume.

The composition of the stainless steel of the invention (hereinafter referred to as the steel of the invention) will now be described in detail.

C: Less than About 0.008 Mass Percent

Carbon (C) increases the strength of steels, but degrades the workability. It also degrades the intergranular corrosion resistance and toughness at the weld zones. Since these adverse effects are significant when the C content is about 0.008 mass percent or more, it is limited to less than about 0.008 mass percent. Preferably, the C content is about 0.0050 mass percent or less, from the viewpoint of toughness at the weld zone.

Si: About 1.0 Mass Percent or Less

Silicon (Si) is an essential element to serve as a deoxidizer. At least about 0.05 mass percent of Si is added to achieve this effect. However, more than about 1.0 mass percent of Si makes steels brittle and also degrades the toughness at the weld zone. Accordingly, the Si content is limited to about 1.0 mass percent or less. Preferably, the Si content is about 0.3 mass percent or less, from the viewpoint of toughness at the weld zone.

Mn: About 1.5 Mass Percent or Less

Manganese (Mn) increases steel strength, but degrades the workability and also degrades the corrosion resistance. Thus, the Mn content is limited to about 1.5 mass percent or less. Preferably, the Mn content is about 1.0 mass percent or less, and more preferably about 0.5 mass percent or less, from the viewpoint of corrosion resistance.

Cr: About 11 to About 15 Mass Percent

Chromium (Cr) enhances the corrosion resistance of stainless steels effectively, and about 11 mass percent or more of Cr is needed to ensure a sufficient corrosion resistance. Preferably, the Cr content is about 12 mass percent or more, and more preferably more than about 13 mass percent, from the viewpoint of corrosion resistance. However, a Cr content of more than about 15 mass percent seriously degrades the toughness and, therefore, the upper limit of the Cr content is about 15 mass percent. Preferably, the Cr content is about 14 mass percent or less from the viewpoint of toughness.

Ni: More than About 1.0 Mass Percent, and About 2.5 Mass Percent or Less

Nickel (Ni) enhances the corrosion resistance, which is one of the features of stainless steels, and the toughness of the base material and weld zones, which is one of the features of structural steels. More than about 1.0 mass percent of Ni is added to achieve these effects. Preferably, the Ni content is more than about 1.5 mass percent from the viewpoint of toughness at the weld zone. More preferably, the Ni content is more than about 1.6 mass percent. However, the effect of enhancing the toughness at the weld zone is saturated at a Ni content of more than about 2.5 mass percent, and material costs are increased. Accordingly, the Ni content is limited to about 2.5 mass percent or less. It is advantageous to set the Ni content to be about 2.2 mass percent or less to further reduce the costs since even a Ni content of about 2.2 mass percent or less can lead to a sufficiently enhanced toughness at the weld zone.

Al: Less than About 0.10 Mass Percent

Aluminium (Al) is an essential element to serve as a deoxidizer in steel making. At least about 0.001 mass percent of Al is added to achieve this effect. However, an excessive amount of Al degrades the toughness and, accordingly, the Al content is limited to less than about 0.10 mass percent.

N: About 0.009 Mass Percent or Less

Nitrogen (N) degrades the intergranular corrosion resistance and toughness at the weld zones, as does carbon. Since these adverse effects are significant when the N content is more than about 0.009 mass percent, it is limited to about 0.009 mass percent or less. Preferably, the N content is limited to less than about 0.008 mass percent. In particular, it is preferable to set the upper limit of the N content to be about 0.005 mass percent from the viewpoint of toughness at the weld zone.

P: About 0.04 Mass Percent or Less

Phosphorus (P) degrades hot workability, and the P content is preferably as low as possible. However, an excessively reduced P content increases steel making costs and, accordingly, the upper limit of the P content is about 0.04 mass percent. Preferably, the P content is about 0.02 mass percent or less from the viewpoint of hot workability.

S: About 0.01 Mass Percent or Less

A high content of sulfur (S) degrades hot workability as does P. In addition, from the viewpoint of reducing the cost of desulfurization in steel making, the S content is limited to about 0.01 mass percent or less. Preferably, the S content is about 0.005 mass percent or less from the viewpoint of hot workability.

The composition of the steel of the invention satisfies expressions (1) to (4).

To obtain excellent corrosion resistance in the base material and intergranular corrosion resistance at the weld zones, which are one of the features of the steel of the invention, it is effective to add Cr and Ni. To ensure their effect, the Cr and Ni contents satisfy experimental formula (1):

$$(Cr)+1.2\times(Ni)\geqq 15.0 \quad (1)$$

This formula has the same meaning as in formulas (5), (8), and (11) described below. In particular, when importance is placed on corrosion resistance, the left side value of formula (1) is preferably 16.0 or more, and more preferably 17.0 or more.

Next, to enhance workability in the base material, it is important to transform the martensitic structure to a soft ferritic structure by annealing. To increase the resistance of the ferrite transformation, the Ni, M, and C contents satisfy formula (2):

$$(Ni)+0.5\times(Mn)+30\times(C)\leqq 3.0 \quad (2)$$

This formula has the same meaning as in formulas (6), (9), and (12) described below. The left side member of formula (2) is based on the Ni equivalent equation of the Schaeffler diagram. Since the Ni equivalent equation does not take Mo and Cu contents into account, they are added to formulas (6), (9), and (12) described later, according to experimental results. Preferably, the left side value of formula (2) is 2.6 or less from the viewpoint of workability of the base material. By satisfying this formula, normal annealing allows the structure of the base material to essentially consist of a ferritic structure and carbide, thereby limiting the tensile strength to about 600 MPa or less.

A steel sheet having a tensile strength of more than about 600 MPa requires large power to be bent and is, thus, difficult to process. The elongation is reduced to about 25% or less, accordingly, and fractures occur easily. This is because the tensile strength is limited to about 600 MPa or less. Preferably, the tensile strength is about 550 MPa or less to further increase the workability.

To enhance the toughness at the welding heat affected zone, it is particularly effective to reduce the C and N contents to satisfy. experimental formula (3):

$$(C)+(N)\leqq 0.015 \quad (3)$$

Preferably, the left side value of formula (3) is 0.012 or less. In particular, a left side value of 0.010 or less can further enhance toughness. Reduction of the C and N contents also leads to a softened material and, thus, contributes to enhancement of workability.

Mn, Ni, C, and N increase the austenite equivalent (the volume percentage of the austenite phase produced at 1000 to 1100° C.), contributes to the production of martensitic structures in the ferrite grain boundaries in the welding heat affected zone, and refines the crystal grains to enhance the toughness. Unfortunately, this process may promote corrosion of grain boundaries in some conditions If the volume percentage of the martensitic structure in the welding heat affected zone is about 5% or less, excellent intergranular corrosion resistance can be obtained. To ensure this percentage, the Mn, Ni, C, and N contents are controlled to prevent the austenite equivalent from excessively increasing and Cr is added to increase the ferrite equivalent (the volume percentage of the ferrite phase produced at 1000 to 1100° C.). In view of the above, experimental formula (4) is satisfied:

$$(Cr)-(Mn)-1.7\times(Ni)-27\times(C)-100\times(N)\geqq 9.0 \quad (4)$$

This formula has the same meaning as in formulas (7), (10), and (13) described below.

In addition to the above-described essential elements, Mo may be added. In this instance, it is important to satisfy formulas (5) to (7) instead of formulas (1), (2), and (4). The meanings of formulas (5) to (7) are the same as those of formulas (1), (2) and (4) described above. Furthermore, at least one of Cu and Co may be added to the above-described essential composition or the composition further including Mo. In this instance, it is important to satisfy formulas (8) to (10) or formulas (11) to (13) instead of formulas (1), (2), and (4). The meanings of formulas (8) to (10) and formulas (11) to (13) are also the same as those of formulas (1), (2), and (4). When one of Cu and Co is added and the content of the other element is less than about 0.02 mass percent, this content is assumed to be 0 mass percent in formulas (8) to (13).

In addition to the above-described essential elements, the following elements may be added as desired.

Mo: About 2.0 Mass Percent or Less

Molybdenum (Mo), which enhances the corrosion resistance effectively, may be added to sufficiently improve the corrosion resistance. Preferably, the Mo content is more than about 0.5 mass percent from the viewpoint of corrosion resistance. However, if the Mo content is more than abut 2.0 mass percent, the effect of improving corrosion resistance is saturated and the resistance to anneal softening is increased to harden the steel and degrade workability. Accordingly, the upper limit of the Mo content is about 2.0 mass percent. To achieve the effect of improving corrosion resistance, about 1.5 mass percent or less of Mo suffices.

Cu: About 2 Mass Percent or Less and/or Co: About 2 Mass Percent or Less

Copper (Cu) and cobalt (Co), which enhance the corrosion resistance effectively as does Mo, may be added as desired. To achieve the effects of improving corrosion resistance and intergranular corrosion resistance, preferably, Cu and Co are each added in amount of about 0.3 mass percent or more. However, if Cu and Co contents are each more than about 2 mass percent, these effects are saturated and the steel is hardened to degrade workability, such as bendability. Accordingly, the Cu and Co contents are limited to about 2 mass percent or less.

B: About 0.0050 Mass Percent or Less and/or Ca: About 0.0050 Mass Percent or Less A small amount of boron (B) and calcium (Ca) enhance toughness at the weld zone of steels and they may be added if necessary. To achieve this effect, B and Ca are each added in amount of about 0.0005 mass percent or more. However, the effect is saturated and the corrosion resistance is degraded at B and Ca contents of more than about 0.0050 mass percent, respectively. Accordingly, at least one of about 0.0050 mass percent of B and Ca is added.

At Least One of About 0.2 Mass Percent or Less of Ti, Nb, V, Zr, and Ta

Titanium (Ti), niobium (Nb), vanadium (V), zirconium (Zr), and tantalum (Ta), small amounts of which enhance the workability of steels, may each be added in an amount of about 0.2 mass percent or less as desired. To achieve their effect, they are each added in an amount of about 0.02 mass percent or more. However, their contents of more than about 0.2 mass percent excessively harden the steel to degrade the workability, respectively. Accordingly, at least one element selected from the group consisting of Ti, Nb, V, Zr, and Ta is added in an amount of about 0.2 mass percent or less each.

W: About 0.10 Mass Percent or Less and/or Mg: About 0.01 Mass Percent or Less

Tungsten (W) and magnesium (Mg), which improve the corrosion resistance of steels, may be added as desired. To achieve this effect, about 0.01 mass percent or more of W and about 0.001 mass percent or more of Mg are added. However, more than about 0.10 mass percent of W and more than about 0.01 mass percent of Mg degrade toughness. Accordingly, at least one of about 0.1 mass percent or less of W and about 0.01 mass percent or less of Mg is added.

The steel sheet of the invention also contains the balance being Fe and incidental impurities. Also, about 0.1 mass percent or less of an alkali metal, an alkaline-earth metal, a rare earth element, and a transition metal may each be contained in the steel sheet. These elements in an amount as small as about 0.1 mass percent or less do not affect the advantages of the invention.

When formulas (4), (7), (10), and (13) are satisfied, the martensite content of the welding heat affected zone becomes less than about 5% by volume and, thus, the intergranular corrosion resistance at the weld zones are satisfactorily enhanced. When the left side value of formulas (4), (7), (10), or (13) is less than 9.0, the martensite content of the welding heat affected zone becomes about 5% by volume or more and, consequently, intergranular corrosion noticeably occurs along the martensitic structures produced in the ferrite grain boundaries. Preferably, the left side value of formulas (4), (7), (10), or (13) is controlled to be 9.5 or more so that no martensitic structure is produced in the welding heat affected zone, from the viewpoint of intergranular corrosion resistance at the weld zones.

The Charpy impact value of heat affected zone at −50° C. (vE-50) must be about 30 J/cm$^2$ or more to ensure toughness at the weld zone required for use in welded structural components. Toughness has conventionally been ensured by producing martensitic structures in an amount about 50% by volume or more to refine crystal grains in the welding heat affected zone. On the other hand, the excellent toughness of the steel of the invention is obtained by adding more than about 1 mass percent of Ni and satisfying formula (3), even if the ferrite grains become larger at the welding heat affected zone. A Charpy impact value vE-50 of less than about 30 J/cm$^2$ may result in brittle fracture in structures under cold conditions. Preferably, the Charpy impact value vE-50 is about 50 J/cm$^2$ or more, and more preferably about 80 J/cm$^2$ or more, from the viewpoint of preventing brittle fracture.

The techniques for making the steel of the invention are not particularly limited, and generally employed techniques for making stainless steels may be used. Preferably, the foregoing essential composition and, if necessary, other elements described above are formed into an ingot in a steel converter, an electric furnace, or the like, and subsequently subjected to secondary refining by vacuum oxygen decarburization (VOD) or argon oxygen decarburization (AOD). The ingot is cast into a steel material according to a known method, and preferably by continuous casting from the viewpoint of productivity and quality.

The resulting steel material is heated to about 1000 to 1250° C., subsequently formed into a sheet bar having a thickness of about 20 to about 40 mm by hot rolling under normal conditions with, for example, a reversing mill, and further formed into a hot-rolled sheet having a desired thickness of about 1.5 to about 8.0 mm with a tandem mill. Alternatively, only the reversing mill is used to form the hot-rolled sheet having a desired thickness of about 1.5 to about 8.0 mm. The resulting hot-rolled sheet is subjected to batch annealing at about 600 to about 800° C., and is, if necessary, descaled by pickling or the like to complete a product. The hot-rolled steel may be subjected to cold rolling, continuous annealing at about 650 to about 850° C., and pickling to prepare a cold-rolled and annealed sheet intended for use as a thin sheet, according to application. The resulting hot-rolled and annealed sheet product or the cold-rolled and annealed sheet product is subjected to bending or welding to form, for example, a pipe or a panel, according to application. Thus, the steel is used for structural components, such as pillars, bands, and beams of railway vehicles, automobiles and buses. These structural components may be welded by proper techniques including, but not limited to, normal arc welding using a metal inert gas (MIG), a metal active gas (MAG), or a tungsten inert gas (TIG); resistance welding such as spot welding or seam welding; and high-frequency resistance welding or high-frequency induction welding such as electric sewing welding.

Since weld cracking is prevented in the steel of the invention because of the sufficiently low C content, the steel can be used as structural components in practice without heat treatment after welding. However, the steel may be subjected to heat treatment for the purpose of adjusting the strength or the like after welding.

EXAMPLE 1

Selected aspects of the invention will be further described in detail with reference to examples and comparative examples.

Each of 50 kg of steel ingot samples having compositions shown in Tables 1 to 3 was melted in a vacuum melting furnace and formed into a hot-rolled sheet having a thickness of 3 mm by normal hot rolling. Then, the resulting hot-rolled sheet was annealed at 650° C. for 15 hours in an atmosphere of argon gas and descaled by pickling to prepare a sample. The sample was subjected to the measurements of the rusted area percentage after a combined cyclic corrosion test (CCT); the volume percentages of the martensitic structures, toughnesses, and intergranular corrosion resistances of the base metal and the welding heat affected zone after welding; and the tensile strength and elongation of the base material.

The CCT was cyclically conducted in combination with salt spraying in accordance with JIS Z 2371, drying, and wetting. Specifically, two test pieces of 70 mm and 150 mm in size were taken from the sample, and one surface of each sample piece was subjected 30 times to an eight-hour cycle combining salt spraying at 35° C. for 2 hours, drying at 60° C. for 4 hours, and wetting at 50° C. for 2 hours. The rusted area was measured by image analysis with a computer, and the obtained area was divided by the area of the test piece to determine the rusted area percentage. The average rusted area percentage of the two test pieces was defined as the CCT-rusted area percentage.

The presence or absence of a ferritic structure and a martensitic structure in the base material after annealing was investigated by etching the section of the sample thickness parallel to the rolling direction using aqua regia (mixture of concentrated nitric and hydrochloric acids with a ratio of 2:1). The etched micro structure was observed by magnification of 1000. If the martensitic structure was hard to distinguish, the Vickers hardness was measured at a test load of 5 kgf in accordance with JIS Z 2244. When the obtained Vickers hardness was 190 or less, it was determined that the base material essentially consists of a ferrite single phase structure and carbon. The Vickers hardness of 190 or less was converted to a tensile strength of 600 MPa or less, according to the hardness conversion table (SAE (Society of Automotive Engineers) J 147, Table 1).

Figure 2:
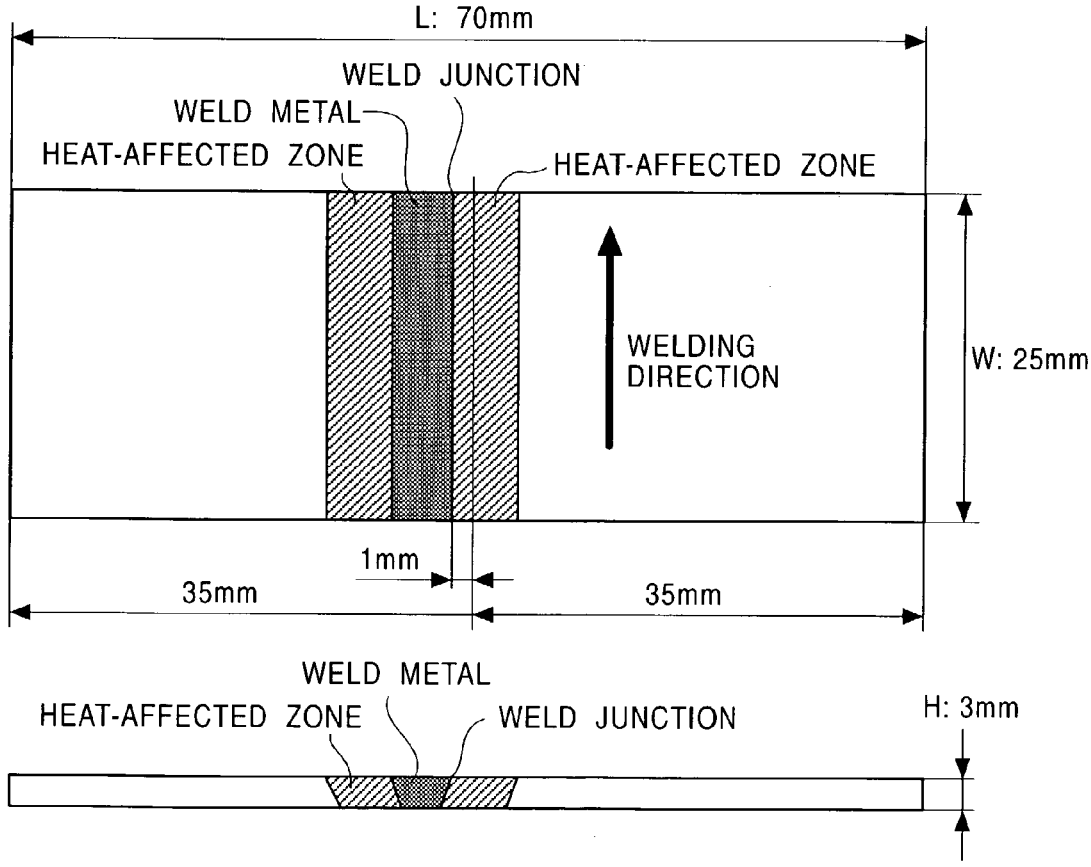
FIG. 2 is a schematic illustration of a metal-inert-gas (MIG) weld zone of an intergranular corrosion test piece.

Test pieces taken from the samples were each subjected to MIG (Metal Inert Gas) butt-welding (wire: JIS Y 308, current: 150 A, voltage: 19 V, welding speed: 9 mm/s, shielding gas: 100% Ar at 20 L/min, root gap: 1 mm). The micro structure, in a section of the test piece perpendicular to the welding direction, of the welding heat affected zone, 1 mm from the weld junction (boundary between the weld metal and the base material) was etched by aqua regia (mixture of concentrated nitric and hydrochloric acids with a ratio of 2:1) and observed by magnification of 100. The area percentage (volume percentage) of the martensitic structures, which was defined as the martensitic structure ratio, was measured by image analysis with a computer. FIG. 1 is a micrography of a micro structure containing 2% by volume of martensitic structures. The martensitic structures were observed in the boundaries of the ferrite crystal grains. Also, the intergranular corrosion resistance was investigated by observing the presence or absence of fracture by intergranular corrosion in the welding heat-affected zone subjected to a bending test after immersion in a boiled solution of sulfuric acid and copper sulfate. The test solution contained 1.8 mass percent of $H_2SO_4$ and 6.4 mass percent of $CuSO_4$ and in which a copper piece was placed so as to be present even after the completion of the test. Each test piece was prepared by grinding the reinforcement of weld and then cut at a width of 25 mm and a length of 70 mm in such a manner that the welding heat-affected zone (1 mm from the weld junction) was located at the center in the longitudinal direction thereof, as shown in FIG. 2. After being continuously subjected to boiling test in the test solution for 16 hours, the test piece was bent 180° at a bend radius of 3.0 mm such that the welding heat-affected zone was located at the center of the bend, and the outer side of the bend was observed with an magnifier to determine the presence or absence of fracture resulting from intergranular corrosion.

Figure 3:
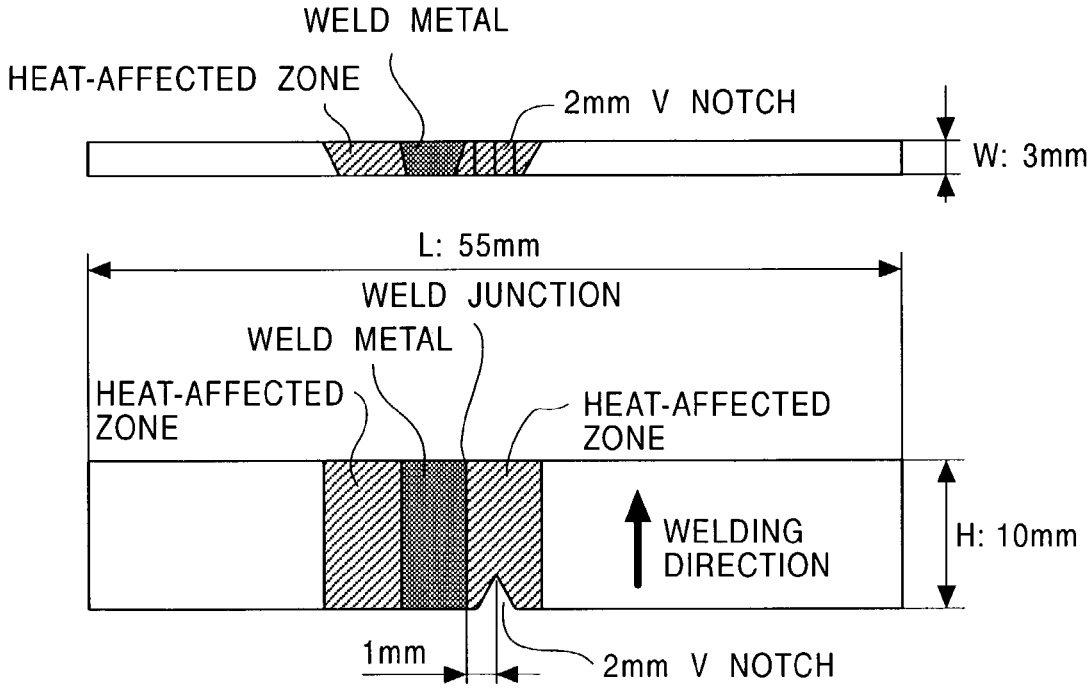
FIG. 3 is a schematic illustration of an MIG weld zone of a Charpy impact test piece.

Moreover, the toughness at the weld zone was evaluated using test pieces, shown in FIG. 3, taken in the same manner as in the test piece shown in FIG. 2. The reinforcement of weld of each test piece was ground and a notch formed at the welding heat affected zone (1 mm from the weld junction). Then, a Charpy impact test was performed on the test piece in accordance with JIS Z 2242. In the Charpy impact test piece, the thickness H was 10 mm, including a V notch of 2 mm in depth; the width W was 3 mm, the reinforcement of weld being removed; and the length L was 55 mm.

The Charpy impact test was performed on five test pieces. The absorption energy of each test piece measured at −50° C. was divided by the sectional area of the notch (0.8 cm×0.3 cm) to obtain a Charpy impact value. The average of obtained Charpy impact values was defined as vE-50 (J/cm$^2$) of the welding heat affected zone.

A tensile test was also performed on test pieces in a JIS Z 2201 13-B shape taken from the samples, in accordance with JIS Z 2241 to determine the tensile strength in the rolling direction and the fracture elongation. The results of the measurements and evaluations are shown in Table 4.

A steel sheet satisfactory for use in vehicle structural components exhibits a rusted area percentage of 30% or less in the CCT test. The metal structure thereof after annealing includes a ferrite single phase and the martensitic structure ratio of the welding heat-affected zone is less than 5% by volume. The welding heat-affected zone has a Charpy impact value at −50° C. (vE-50) of 30 J/cm$^2$ or more and does not exhibit fracture in the intergranular corrosion test, having a fracture elongation of 30% or more.

As shown in Table 4, the steel sheet according to the invention has excellent corrosion resistance, and whose welding heat affected zone has excellent toughness and intergranular corrosion resistance. Also, the base material thereof exhibits low strength, high elongation, and excellent workability. In contrast, the samples of the comparative examples have poor characteristics in comparison with the samples of the examples according to the invention.

EXAMPLE 2

The characteristics of a cold-rolled and annealed steel sheet were evaluated. The hot-rolled steel sheet of Sample No. 11 in Table 1, prepared in EXAMPLE 1 and having a thickness of 3 mm was cold-rolled to a thickness of 1.5 mm, followed by annealing at 750° C. for 1 minute. The resulting sheet was immersed in a mixed acid having a temperature of 60° C., containing 10 mass percent of nitric acid and 3 mass percent of hydrofluoric acid for descaling to obtain a cold-rolled and annealed steel sheet. The same tests as in EXAMPLE 1 were performed on the cold-rolled and annealed steel sheet. However, for the welding to evaluate the toughness at the weld zone, TIG (Tungsten Inert Gas) welding was performed under the following conditions: current: 95 A, voltage: 11 V, welding speed: 400 mm/min, shielding gas: Ar gas 20 L/min (electrode side), Ar gas 10 L/min (reverse side). As a result, the CCT rusted area percentage was 15%, as for the corrosion resistance. The metal structure after annealing essentially consisted of a ferrite single phase and carbide, with a martensitic structure ratio of 0%. As for the characteristics of the welding heat affected zone, the Charpy impact value at −50° C. (vE-50), for evaluating the toughness, was 90 J/cm$^2$, and no fracture was exhibited in the intergranular corrosion test. As for the mechanical characteristics, the tensile strength was 485 MPa and the fracture elongation was 35%. It has been shown that the cold-rolled and annealed sheet also has substantially the same characteristics as the hot-rolled and annealed sheet has.

As described above, the invention can provide a stainless steel having excellent corrosion resistance and workability in the base material, and further having excellent intergranular corrosion resistance and toughness at the welding heat affected zone. Accordingly, the steel of the invention is suitably used for structural components of vehicles, such as railway vehicles, automobiles, and buses, and civil engineering structural components.

TABLE 1

| Sample | Chemical composition (mass %) | | | | | | | | | | | | |
|---|---|---|---|---|---|---|---|---|---|---|---|---|---|
| No. | C | Si | Mn | P | S | Cr | Ni | Mo | Cu | Co | Al | N | Others |
| 1 | 0.0041 | 0.22 | 0.22 | 0.01 | 0.004 | 11.3 | 1.25 | 1.53 | 0.0 | 0.0 | 0.005 | 0.0048 | |
| 2 | 0.0074 | 0.23 | 0.28 | 0.02 | 0.003 | 12.6 | 1.68 | 1.43 | 0.0 | 0.0 | 0.030 | 0.0040 | |
| 3 | 0.0048 | 0.25 | 0.32 | 0.02 | 0.003 | 12.4 | 1.70 | 0.43 | 0.0 | 0.0 | 0.004 | 0.0043 | V:0.12 |
| 4 | 0.0033 | 0.23 | 1.32 | 0.03 | 0.001 | 12.6 | 1.33 | 0.95 | 0.0 | 0.0 | 0.022 | 0.0046 | |
| 5 | 0.0044 | 0.15 | 0.28 | 0.02 | 0.004 | 13.8 | 1.05 | 0.00 | 0.0 | 0.0 | 0.025 | 0.0045 | |
| 6 | 0.0024 | 0.21 | 0.81 | 0.01 | 0.003 | 13.1 | 1.78 | 0.83 | 0.5 | 0.0 | 0.004 | 0.0044 | B:0.0011 |
| 7 | 0.0058 | 0.25 | 0.35 | 0.02 | 0.003 | 13.5 | 1.12 | 1.68 | 0.0 | 0.0 | 0.006 | 0.0041 | Ta:0.15 |
| 8 | 0.0033 | 0.15 | 0.28 | 0.01 | 0.004 | 13.7 | 1.70 | 1.11 | 0.0 | 0.0 | 0.031 | 0.0066 | |
| 9 | 0.0026 | 0.14 | 0.32 | 0.02 | 0.005 | 13.5 | 1.68 | 0.89 | 0.0 | 0.0 | 0.028 | 0.0033 | Zr:0.08 |
| 10 | 0.0047 | 0.11 | 0.32 | 0.02 | 0.003 | 13.6 | 2.32 | 0.58 | 0.0 | 0.3 | 0.002 | 0.0041 | Ti:0.08, V:0.06 |
| 11 | 0.0041 | 0.10 | 0.33 | 0.02 | 0.002 | 13.3 | 1.85 | 1.00 | 0.0 | 0.0 | 0.012 | 0.0042 | |
| 12 | 0.0050 | 0.10 | 0.15 | 0.02 | 0.003 | 13.2 | 2.00 | 0.80 | 0.0 | 0.0 | 0.005 | 0.0046 | Ca:0.0008 |
| 13 | 0.0043 | 0.22 | 0.15 | 0.02 | 0.003 | 13.3 | 2.11 | 1.12 | 0.0 | 0.0 | 0.015 | 0.0039 | Ti:0.11 |
| 14 | 0.0049 | 0.12 | 0.12 | 0.02 | 0.002 | 13.1 | 2.08 | 0.98 | 0.0 | 0.0 | 0.004 | 0.0042 | |

| Sample No. | Left-side value of formula (1), (5), (8), or (11) | Left-side value of formula (4), (7), (10), or (13) | Left-side value of formula (3) | Left-side value of formula (2), (6), (9), or (12) | Remark |
|---|---|---|---|---|---|
| 1 | 15.1 | 9.6 | 0.0089 | 2.2 | I. Ex |
| 2 | 16.8 | 10.0 | 0.0114 | 2.8 | I. Ex |
| 3 | 15.1 | 9.0 | 0.0091 | 2.2 | I. Ex |
| 4 | 15.6 | 9.2 | 0.0079 | 2.6 | I. Ex |
| 5 | 15.1 | 11.2 | 0.0089 | 1.3 | I. Ex |
| 6 | 16.7 | 9.3 | 0.0068 | 2.9 | I. Ex |
| 7 | 17.4 | 12.0 | 0.0099 | 2.3 | I. Ex |
| 8 | 17.4 | 10.7 | 0.0099 | 2.5 | I. Ex |
| 9 | 16.9 | 10.6 | 0.0059 | 2.4 | I. Ex |
| 10 | 17.3 | 9.3 | 0.0088 | 2.9 | I. Ex |
| 11 | 17.0 | 10.1 | 0.0083 | 2.6 | I. Ex |
| 12 | 16.8 | 9.7 | 0.0096 | 2.6 | I. Ex |
| 13 | 17.5 | 10.0 | 0.0082 | 2.9 | I. Ex |
| 14 | 17.1 | 9.7 | 0.0091 | 2.8 | I. Ex |

I. Ex: Example of the invention

TABLE 2

| Sample | Chemical composition (mass %) | | | | | | | | | | | | |
|---|---|---|---|---|---|---|---|---|---|---|---|---|---|
| No. | C | Si | Mn | P | S | Cr | Ni | Mo | Cu | Co | Al | N | Others |
| 15 | 0.0024 | 0.33 | 0.92 | 0.04 | 0.008 | 13.5 | 1.92 | 1.02 | 0.0 | 0.0 | 0.033 | 0.0039 | W:0.04 |
| 16 | 0.0018 | 0.85 | 0.26 | 0.02 | 0.003 | 13.8 | 1.65 | 1.21 | 1.0 | 0.0 | 0.047 | 0.0048 | |
| 17 | 0.0033 | 0.21 | 0.32 | 0.01 | 0.003 | 13.1 | 1.68 | 1.89 | 0.0 | 0.0 | 0.020 | 0.0050 | |
| 18 | 0.0049 | 0.19 | 0.22 | 0.02 | 0.004 | 13.2 | 2.02 | 1.04 | 0.0 | 0.5 | 0.006 | 0.0047 | |
| 19 | 0.0044 | 0.45 | 0.15 | 0.01 | 0.003 | 13.5 | 2.11 | 0.85 | 0.0 | 0.0 | 0.022 | 0.0045 | Nb:0.12 |
| 20 | 0.0048 | 0.19 | 0.21 | 0.02 | 0.004 | 13.1 | 1.75 | 0.88 | 0.0 | 0.0 | 0.004 | 0.0064 | Mg:0.009 |
| 21 | 0.0047 | 0.12 | 0.36 | 0.03 | 0.005 | 14.7 | 1.66 | 1.03 | 0.0 | 0.0 | 0.006 | 0.0041 | |
| 22 | 0.0023 | 0.12 | 0.33 | 0.02 | 0.003 | 13.1 | 1.55 | 0.85 | 0.0 | 0.0 | 0.001 | 0.0090 | |
| 23 | 0.0042 | 0.25 | 0.32 | 0.02 | 0.004 | 13.5 | 1.62 | 0.00 | 0.0 | 0.0 | 0.005 | 0.0041 | |
| 24 | 0.0038 | 0.24 | 0.21 | 0.01 | 0.005 | 13.3 | 1.59 | 0.00 | 1.5 | 0.0 | 0.003 | 0.0054 | |
| 25 | 0.0041 | 0.18 | 0.25 | 0.02 | 0.003 | 13.5 | 1.64 | 0.00 | 0.0 | 0.8 | 0.002 | 0.0048 | |
| 26 | 0.0067 | 0.22 | 0.25 | 0.02 | 0.003 | 13.3 | 1.61 | 0.91 | 0.0 | 0.0 | 0.012 | 0.0083 | |
| 27 | 0.0088 | 0.11 | 0.23 | 0.02 | 0.003 | 13.2 | 1.73 | 0.88 | 0.0 | 0.0 | 0.015 | 0.0011 | |
| 28 | 0.0048 | 1.09 | 0.25 | 0.02 | 0.004 | 13.3 | 1.68 | 1.23 | 0.0 | 0.4 | 0.023 | 0.0046 | Ti:0.09 |

TABLE 2-continued

| Sample No. | Left-side value of formula (1), (5), (8), or (11) | Left-side value of formula (4), (7), (10), or (13) | Left-side value of formula (3) | Left-side value of formula (2), (6), (9), or (12) | Remark |
|---|---|---|---|---|---|
| 15 | 17.3 | | 0.0063 | 3.0 | I. Ex |
| 16 | 18.1 | 10.9 | 0.0066 | 2.9 | I. Ex |
| 17 | 18.0 | 10.8 | 0.0083 | 2.9 | I. Ex |
| 18 | 17.3 | 9.8 | 0.0096 | 2.8 | I. Ex |
| 19 | 17.3 | 9.9 | 0.0089 | 2.7 | I. Ex |
| 20 | 16.5 | 9.8 | 0.0112 | 2.4 | I. Ex |
| 21 | 18.2 | 11.8 | 0.0088 | 2.5 | I. Ex |
| 22 | 16.2 | 9.9 | 0.0113 | 2.2 | I. Ex |
| 23 | 15.4 | 9.9 | 0.0083 | 1.9 | I. Ex |
| 24 | 16.0 | 9.3 | 0.0092 | 2.6 | I. Ex |
| 25 | 15.7 | 9.9 | 0.0089 | 1.9 | I. Ex |
| 26 | 16.6 | 10.0 | 0.0150 | 2.4 | I. Ex |
| 27 | 16.6 | 10.4 | 0.0099 | 2.5 | C. Ex |
| 28 | 17.3 | 10.6 | 0.0094 | 2.6 | C. Ex |

I. Ex: Example of the invention
C. Ex: Comparative Example

TABLE 3

| Sample | Chemical composition (mass %) | | | | | | | | | | | | |
|---|---|---|---|---|---|---|---|---|---|---|---|---|---|
| No. | C | Si | Mn | P | S | Cr | Ni | Mo | Cu | Co | Al | N | Others |
| 29 | 0.0047 | 0.11 | 1.61 | 0.01 | 0.002 | 13.3 | 1.62 | 0.94 | 0.0 | 0.0 | 0.036 | 0.0046 | |
| 30 | 0.0028 | 0.22 | 0.12 | 0.02 | 0.002 | 10.6 | 1.45 | 1.88 | 0.0 | 0.0 | 0.003 | 0.0038 | |
| 31 | 0.0039 | 0.13 | 0.25 | 0.02 | 0.003 | 13.2 | 0.93 | 1.37 | 0.0 | 0.0 | 0.023 | 0.0037 | |
| 32 | 0.0036 | 0.26 | 0.08 | 0.02 | 0.004 | 13.4 | 2.61 | 0.56 | 0.0 | 0.0 | 0.015 | 0.0027 | |
| 33 | 0.0048 | 0.29 | 0.14 | 0.01 | 0.004 | 13.5 | 1.72 | 1.33 | 0.5 | 0.0 | 0.113 | 0.0039 | Ca:0.0011 |
| 34 | 0.0019 | 0.21 | 0.13 | 0.01 | 0.002 | 13.5 | 1.55 | 0.96 | 0.0 | 0.0 | 0.0015 | 0.0096 | |
| 35 | 0.0074 | 0.15 | 0.16 | 0.02 | 0.003 | 13.3 | 1.63 | 1.05 | 0.0 | 0.0 | 0.003 | 0.0084 | |
| 36 | 0.0044 | 0.22 | 0.08 | 0.02 | 0.002 | 11.6 | 1.48 | 0.73 | 0.0 | 0.0 | 0.003 | 0.0050 | |
| 37 | 0.0042 | 0.23 | 0.17 | 0.02 | 0.004 | 12.2 | 2.05 | 0.31 | 0.0 | 0.0 | 0.003 | 0.0032 | |
| 38 | 0.0049 | 0.17 | 0.45 | 0.02 | 0.003 | 13.8 | 2.12 | 1.43 | 0.0 | 0.0 | 0.031 | 0.0047 | |
| 39 | 0.0047 | 0.28 | 0.23 | 0.02 | 0.003 | 13.1 | 1.69 | 2.13 | 0.0 | 0.0 | 0.016 | 0.0037 | |
| 40 | 0.0044 | 0.12 | 0.21 | 0.02 | 0.004 | 15.6 | 1.93 | 0.84 | 0.0 | 0.0 | 0.028 | 0.0048 | |

| Sample No. | Left-side value of formula (1), (5), (8), or (11) | Left-side value of formula (4), (7), (10), or (13) | Left-side value of formula (3) | Left-side value of formula (2), (6), (9), or (12) | Remark |
|---|---|---|---|---|---|
| 29 | 16.7 | 9.1 | 0.0093 | 3.0 | C. Ex |
| 30 | 15.2 | 9.1 | 0.0066 | 2.5 | C. Ex |
| 31 | 16.4 | 12.0 | 0.0076 | 1.9 | C. Ex |
| 32 | 17.4 | 9.0 | 0.0063 | 3.0 | C. Ex |
| 33 | 17.8 | 10.8 | 0.0087 | 2.8 | C. Ex |
| 34 | 16.8 | 10.5 | 0.0115 | 2.2 | C. Ex |
| 35 | 16.8 | 10.2 | 0.0158 | 2.5 | C. Ex |
| 36 | 14.5 | 9.0 | 0.0094 | 2.0 | C. Ex |
| 37 | 15.1 | 8.4 | 0.0074 | 2.4 | C. Ex |
| 38 | 18.5 | 10.3 | 0.0096 | 3.2 | C. Ex |
| 39 | 18.3 | 11.2 | 0.0084 | 3.0 | C. Ex |
| 40 | 19.2 | 12.2 | 0.0092 | 2.6 | C. Ex |

C. Ex: Comparative Example

TABLE 4

| Sample No. | CCT rusted area percentage (%) | Metal structure after annealing F: Ferrite M: Martensite | Martensite ratio of welding heat-affected zone (volume %) | vE-50° C. at welding heat-affected zone ($J/cm^2$) | Presence of fracture by intergranular corrosion test at welding heat-affected zone | Tensile strength (MPa) | Elongation (%) | Remark |
|---|---|---|---|---|---|---|---|---|
| 1 | 28 | F | 0 | 86 | No | 486 | 34 | I. Ex |
| 2 | 19 | F | 0 | 46 | No | 556 | 30 | I. Ex |
| 3 | 27 | F | 4 | 99 | No | 459 | 33 | I. Ex |
| 4 | 29 | F | 3 | 81 | No | 523 | 31 | I. Ex |
| 5 | 29 | F | 0 | 35 | No | 442 | 36 | I. Ex |
| 6 | 2 | F | 2 | 117 | No | 494 | 32 | I. Ex |

TABLE 4-continued

| Sample No. | CCT rusted area percentage (%) | Metal structure after annealing F: Ferrite M: Martensite | Martensite ratio of welding heat-affected zone (volume %) | vE-50° C. at welding heat-affected zone (J/cm$^2$) | Presence of fracture by intergranular corrosion test at welding heat-affected zone | Tensile strength (MPa) | Elongation (%) | Remark |
|---|---|---|---|---|---|---|---|---|
| 7 | 12 | F | 0 | 32 | No | 530 | 31 | I. Ex |
| 8 | 13 | F | 0 | 46 | No | 525 | 31 | I. Ex |
| 9 | 11 | F | 0 | 84 | No | 483 | 34 | I. Ex |
| 10 | 3 | F | 2 | 93 | No | 536 | 30 | I. Ex |
| 11 | 13 | F | 0 | 82 | No | 491 | 33 | I. Ex |
| 12 | 12 | F | 0 | 84 | No | 487 | 33 | I. Ex |
| 13 | 18 | F | 0 | 51 | No | 501 | 31 | I. Ex |
| 14 | 17 | F | 0 | 81 | No | 494 | 32 | I. Ex |
| 15 | 10 | F | 0 | 98 | No | 492 | 32 | I. Ex |
| 16 | 7 | F | 0 | 47 | No | 576 | 30 | I. Ex |
| 17 | 10 | F | 0 | 86 | No | 522 | 31 | I. Ex |
| 18 | 7 | F | 0 | 98 | No | 497 | 32 | I. Ex |
| 19 | 15 | F | 0 | 95 | No | 522 | 31 | I. Ex |
| 20 | 18 | F | 0 | 53 | No | 557 | 32 | I. Ex |
| 21 | 16 | F | 0 | 38 | No | 502 | 33 | I. Ex |
| 22 | 8 | F | 0 | 51 | No | 528 | 31 | I. Ex |
| 23 | 24 | F | 0 | 98 | No | 449 | 36 | I. Ex |
| 24 | 15 | F | 2 | 113 | No | 490 | 34 | I. Ex |
| 25 | 18 | F | 0 | 96 | No | 449 | 36 | I. Ex |
| 26 | 7 | F | 0 | 48 | No | 539 | 30 | I. Ex |
| 27 | 16 | F | 3 | 23 | YES | 569 | 26 | C. Ex |
| 28 | 5 | F | 0 | 22 | No | 610 | 18 | C. Ex |
| 29 | 45 | F | 4 | 88 | No | 485 | 33 | C. Ex |
| 30 | 73 | F | 4 | 83 | No | 496 | 32 | C. Ex |
| 31 | 19 | F | 0 | 17 | No | 489 | 33 | C. Ex |
| 32 | 14 | F | 4 | 87 | No | 564 | 21 | C. Ex |
| 33 | 12 | F | 0 | 11 | No | 519 | 32 | C. Ex |
| 34 | 9 | F | 0 | 21 | YES | 541 | 23 | C. Ex |
| 35 | 10 | F | 0 | 19 | YES | 554 | 24 | C. Ex |
| 36 | 80 | F | 4 | 92 | No | 491 | 34 | C. Ex |
| 37 | 24 | F | 12 | 103 | YES | 458 | 33 | C. Ex |
| 38 | 4 | F + M | 0 | 42 | No | 619 | 22 | C. Ex |
| 39 | 19 | F | 0 | 51 | No | 563 | 21 | C. Ex |
| 40 | 13 | F | 0 | 10 | No | 536 | 27 | C. Ex |

I. Ex: Example the invention
C. Ex: Comparative Example

What is claimed is:

1. A substantially ferritic stainless steel welded sheet comprising:

less than about 0.008 mass percent of C;
about 1.0 mass percent or less of Si;
about 1.5 mass percent or less of Mn;
about 11 to about 15 mass percent of Cr;
more than 2.0 mass percent and about 2.5 mass percent or less of Ni;
less than about 0.10 mass percent of Al;
about 0.009 mass percent or less of N;
about 0.04 mass percent or less of P;
about 0.01 mass percent or less of S;
Ti and Nb in an amount no more than incidental impurities; and
the balance being Fe and incidental impurities, wherein expressions (1) to (4) are satisfied:

$$(Cr)+1.2\times(Ni)\geqq 15.0 \quad (1)$$

$$(Ni)+0.5\times(Mn)+30\times(C)\leqq 3.0 \quad (2)$$

$$(C)+(N)\leqq 0.015 \quad (3)$$

$$(Cr)-(Mn)-1.7\times(Ni)-27\times(C)-100\times(N)\geqq 9.0 \quad (4)$$

where (Cr), (Ni), (Mn), (C), and (N) represent Cr, Ni, Mn, C, and N contents on a mass percent basis, respectively, and wherein the sheet has a welding heat affected zone and the volume percentage of the martensitic structure produced in the welding heat affected zone is less than about 5 percent, the Charpy impact value of the welding heat affected zone is about 30 J/cm$^2$ or more at −50° C., and the stainless steel sheet has a tensile strength of about 600 MPa or less.

2. A substantially ferritic stainless steel welded sheet comprising:

less than abut 0.008 mass percent of C;
about 1.0 mass percent or less of Si;
about 1.5 mass percent or less of Mn;
about 11 to 15 mass percent of Cr;
more than 2.0 mass percent and about 2.5 mass percent or less of Ni;
less than about 0.10 mass percent of Al;
about 0.009 mass percent or less of N;
about 0.04 mass percent or less of P;
about 0.01 mass percent or less of S;
about 2.0 mass percent or less of Mo;
Ti and Nb in an amount no more than incidental impurities; and
the balance being Fe and incidental impurities, wherein expressions (3), (5), (6), and (7) are satisfied:

$$(C)+(N)\leqq 0.015 \quad (3)$$

$$(Cr)+1.2\times(Ni)+1.5\times(Mo)\geqq 15.0 \quad (5)$$

$$(Ni)+0.5\times((Mn)+(Mo))+30\times(C)\leqq 3.0 \quad (6)$$

$$(Cr)+0.8\times(Mo)-(Mn)-1.7\times(Ni)-27\times(C)-100\times(N)\geqq 9.0 \quad (7)$$

where (Cr), (Mo), (Ni), (Mn), (C), and (N) represent Cr, Mo, Ni, Mn, C, and N contents on a mass percent basis, respectively, and wherein the sheet has a welding heat affected zone and the volume percentage of the martensitic structure produced in the welding heat affected zone is less than about 5 percent, the Charpy impact value of the welding heat affected zone is about 30 J/cm$^2$ or more at −50° C., and the stainless steel sheet has a tensile strength of about 600 MPa or less.

3. A substantially ferritic stainless steel welded sheet comprising:

less than about 0.008 mass percent of C;

about 1.0 mass percent or less of Si;

about 1.5 mass percent or less of Mn;

about 11 to about 15 mass percent of Cr;

more than 2.0 mass percent and about 2.5 mass percent or less of Ni;

less than about 0.10 mass percent of Al;

about 0.009 mass percent or less of N;

about 0.04 mass percent or less of P;

about 0.01 mass percent or less of S;

at least one of about 2 mass percent or less of Cu and about 2 mass percent or less of Co;

Ti and Nb in an amount no more than incidental impurities; and the balance being Fe and incidental impurities, wherein expressions (3), (8), (9), and (10) are satisfied:

$$(C)+(N)\leqq 0.015 \quad (3)$$

$$(Cr)+1.2\times(Ni)+0.5\times(Cu)+0.3\times(Co)\geqq 15.0 \quad (8)$$

$$(Ni)+0.5\times((Mn)+(Cu))+30\times(C)\leqq 3.0 \quad (9)$$

$$(Cr)-(Mn)-1.7\times(Ni)-27\times(C)-100\times(N)-0.3\times(CU)\geqq 9.0 \quad (10)$$

where (Cr), (Ni), (Mn), (Cu), (Co), (C), and (N) represent Cr, Ni, Mn, Cu, Co, C, and N contents on a mass percent basis, respectively, and wherein the sheet has a welding heat affected zone and the volume percentage of the martensitic structure produced in the welding heat affected zone is less than about 5 percent, the Charpy impact value of the welding heat affected zone is about 30 J/cm$^2$ or more at −50° C., and the stainless steel sheet has a tensile strength of about 600 MPa or less.

4. A substantially ferritic stainless steel welded sheet comprising:

less than about 0.008 mass percent of C;

about 1.0 mass percent or less of Si;

about 1.5 mass percent or less of Mn;

about 11 to about 15 mass percent of Cr;

more than 2.0 mass percent and about 2.5 mass percent or less of Ni;

less than about 0.10 mass percent of Al;

about 0.009 mass percent or less of N;

about 0.04 mass percent or less of P;

about 0.01 mass percent or less of S;

about 2.0 mass percent or less of Mo;

at least one of about 2 mass percent or less of Cu and about 2 mass percent or less of Co;

Ti and Nb in an amount no more than incidental impurities; and the balance being Fe and incidental impurities, wherein expressions (3), (11), (12), and (13) are satisfied:

$$(C)+(N)\leqq 0.015 \quad (3)$$

$$(Cr)+1.2\times(Ni)+1.5\times(Mo)+0.5\times(Cu)+0.3\times(Co)\geqq 15.0 \quad (11)$$

$$(Ni)+0.5\times((Mn)+(Mo)+(Cu))+30\times(C)\leqq 3.0 \quad (12)$$

$$(Cr)+0.8\times(Mo)-(Mn)-1.7\times(Ni)-27\times(C)-100\times(N)-0.3\times(Cu)\geqq 9.0 \quad (13)$$

where (Cr), (Mo), (Ni), (Mn), (Cu), (Co), (C), and (N) represent Cr, Mo, Ni, Mn, Cu, Co, C, and N contents on a mass percent basis, respectively and wherein the sheet has a welding heat affected zone and the volume percentage of the martensitic structure produced in the welding heat affected zone is less than about 5 percent, the Charpy impact value of the welding heat affected zone is about 30 J/cm$^2$ or more at −50° C., and the stainless steel sheet has a tensile strength of about 600 MPa or less.

5. The stainless steel welded sheet according to claim 1, further comprising at least one of about 0.0050 mass percent or less of B and about 0.0050 mass percent or less of Ca.

6. The stainless steel welded sheet according to claim 2, further comprising at least one of about 0.0050 mass percent or less of B and about 0.0050 mass percent or less of Ca.

7. The stainless steel welded sheet according to claim 3, further comprising at least one of about 0.0050 mass percent or less of B and about 0.0050 mass percent or less of Ca.

8. The stainless steel welded sheet according to claim 4, further comprising at least one of about 0.0050 mass percent or less of B and about 0.0050 mass percent or less of Ca.

9. The stainless steel welded sheet according to claim 1, further comprising at least one component selected from the group consisting of about 0.2 mass percent or less of V, about 0.2 mass percent or less of Zr, and about 0.2 mass percent or less of Ta.

10. The stainless steel welded sheet according to claim 2, further comprising at least one component selected from the group consisting of about 0.2 mass percent or less of V, about 0.2 mass percent or less of Zr, and about 0.2 mass percent or less of Ta.

11. The stainless steel welded sheet according to claim 3, further comprising at least one component selected from the group consisting of about 0.2 mass percent or less of V, about 0.2 mass percent or less of Zr, and about 0.2 mass percent or less of Ta.

12. The stainless steel welded sheet according to claim 4, further comprising at least one component selected from the group consisting of about 0.2 mass percent or less of V, about 0.2 mass percent or less of Zr, and about 0.2 mass percent or less of Ta.

13. The stainless steel welded sheet according to claim 1, further comprising at least one of about 0.10 mass percent or less of W and about 0.01 mass percent or less of Mg.

14. The stainless steel welded sheet according to claim 2, further comprising at least one of about 0.10 mass percent or less of W and about 0.01 mass percent or less of Mg.

15. The stainless steel welded sheet according to claim 3, further comprising at least one of about 0.10 mass percent or less of W and about 0.01 mass percent or less of Mg.

16. The stainless steel welded sheet according to claim 4, further comprising at least one of about 0.10 mass percent or less of W and about 0.01 mass percent or less of Mg.

17. The stainless steel welded sheet according to claim 1, wherein the steel sheet is a hot-rolled substantially ferritic steel sheet.

18. The stainless steel welded sheet according to claim 2, wherein the steel sheet is a hot-rolled substantially ferritic steel sheet.

19. The stainless steel welded sheet according to claim 3, wherein the steel sheet is a hot-rolled substantially ferritic steel sheet.

20. The stainless steel welded sheet according to claim 4, wherein the steel sheet is a hot-rolled substantially ferritic steel sheet.

21. The stainless steel welded sheet according to claim 1, wherein the steel sheet is a cold-rolled substantially ferritic steel sheet.

22. The stainless steel welded sheet according to claim 2, wherein the steel sheet is a cold-rolled substantially ferritic steel sheet.

23. The stainless steel welded sheet according to claim 3, wherein the steel sheet is a cold-rolled substantially ferritic steel sheet.

24. The stainless steel welded sheet according to claim 4, wherein the steel sheet is a cold-rolled substantially ferritic steel sheet.

25. A method for making a hot-rolled substantially ferritic stainless steel sheet, comprising the steps of:

hot-rolling a steel slab;

batch annealing the hot-rolled sheet at a temperature of 600-800° C.; and optionally, pickling the hot-rolled sheet, wherein the steel slab comprises:

less than about 0.008 mass percent of C;

about 1.0 mass percent or less of Si;

about 1.5 mass percent or less of Mn;

about 11 to bout 15 mass percent of Cr;

more than 2.0 mass percent and about 2.5 mass percent or less of Ni;

less than about 0.10 mass percent of Al;

about 0.009 mass percent or less of N;

about 0.04 mass percent or less of P;

about 0.01 mass percent or less of S;

Ti and Nb in an amount no more than incidental impurities; and the balance being Fe and incidental impurities, wherein expressions (1) to (4) are satisfied:

$$(Cr)+1.2\times(Ni)\geqq 15.0 \quad (1)$$

$$(Ni)+0.5\times(Mn)+30\times(C)\leqq 3.0 \quad (2)$$

$$(C)+(N)\leqq 0.015 \quad (3)$$

$$(Cr)-(Mn)-1.7\times(Ni)-27\times(C)-100\times(N)\geqq 9.0 \quad (4)$$

where (Cr), (Ni), (Mn), (C), and (N) represent Cr, Ni, Mn, C, and N contents on a mass percent basis, respectively.

26. A method for making a hot-rolled substantially ferritic stainless steel sheet, comprising the steps of:

hot-rolling a steel slab;

batch annealing the hot-rolled sheet at a temperature of 600-800° C.; and optionally, pickling the hot-rolled sheet, wherein the steel slab comprises:

less than about 0.008 mass percent of C;

about 1.0 mass percent or less of Si;

about 1.5 mass percent or less of Mn;

about 11 to about 15 mass percent of Cr;

more than 2.0 mass percent and about 2.5 mass percent or less of Ni;

less than about 0.10 mass percent of Al;

about 0.009 mass percent or less of N;

about 0.04 mass percent or less of P;

about 0.01 mass percent or less of S;

about 2.0 mass percent or less of Mo;

Ti and Nb in an amount no more than incidental impurities; and the balance being Fe and incidental impurities, wherein expressions (3), (5), (6), and (7) are satisfied:

$$(C)+(N)\leqq 0.015 \quad (3)$$

$$(Cr)+1.2\times(Ni)+1.5\times(Mo)\geqq 15.0 \quad (5)$$

$$(Ni)+0.5\times((Mn)+(Mo))+30\times(C)-\geqq 3.0 \quad (6)$$

$$(Cr)+0.8\times(Mo)-(Mn)-1.7\times(Ni)-27\times(C)-100\times(N)\geqq 9.0 \quad (7)$$

where (Cr), (Mo), (Ni), (Mn), (C), and (N) represent Cr, Mo, Ni, Mn, C, and N contents on a mass percent basis, respectively.

27. A method for making a hot-rolled substantially ferritic stainless steel sheet, comprising the steps of:

hot-rolling a steel slab;

batch annealing the hot-rolled sheet at a temperature of 600-800° C.; and optionally, pickling the hot-rolled sheet, wherein the steel slab comprises:

less than about 0.008 mass percent of C;

about 1.0 mass percent or less of Si;

about 1.5 mass percent or less of Mn;

about 11 to about 15 mass percent of Cr;

more than 2.0 mass percent and about 2.5 mass percent or less of Ni;

less than about 0.10 mass percent of Al;

about 0.009 mass percent or less of N;

about 0.04 mass percent or less of P;

about 0.01 mass percent or less of S;

at least one of about 2 mass percent or less of Cu and about 2 mass percent or less of Co;

Ti and Nb in an amount no more than incidental impurities; and the balance being Fe and incidental impurities, wherein expressions (3), (8), (9), and (10) are satisfied:

$$(C)+(N)\leqq 0.015 \quad (3)$$

$$(Cr)+1.2\times(Ni)+0.5\times(Cu)+0.3\times(Co)\geqq 15.0 \quad (8)$$

$$(Ni)+0.5\times((Mn)+(Cu))+30\times(C)\leqq 3.0 \quad (9)$$

$$(Cr)-(Mn)-1.7\times(Ni)-27\times(C)-100\times(N)-0.3\times(Cu)\geqq 9.0 \quad (10)$$

where (Cr), (Ni), (Mn), (Cu), (Co), (C), and (N) represent Cr, Ni, Mn, Cu, Co, C, and N contents on a mass percent basis, respectively.

28. A method for making a hot-rolled substantially ferritic stainless steel sheet, comprising the steps of:

hot-rolling steel slab;

batch annealing the hot-rolled sheet at a temperature of 600-800° C.; and optionally, pickling the hot-rolled sheet, wherein the steel slab comprises:

less than about 0.008 mass percent of C;

about 1.0 mass percent or less of Si;

about 1.5 mass percent or less of Mn;

about 11 to about 15 mass percent of Cr;

more than 2.0 mass percent and about 2.5 mass percent or less of Ni;

less than about 0.10 mass percent of Al;

about 0.009 mass percent or less of N;

about 0.04 mass percent or less of P;

about 0.01 mass percent or less of S;

about 2.0 mass percent or less of Mo;

at least one of about 2 mass percent or less of Cu and about 2 mass percent or less of Co;

Ti and Nb in an amount no more than incidental impurities; and the balance being Fe and incidental impurities, wherein expressions (3), (11), (12), and (13) are satisfied:

$$(C)+(N)\leqq 0.015 \quad (3)$$

$$(Cr)+1.2\times(Ni)+1.5\times(Mo)+0.5\times(Cu)+0.3\times(Co)\geqq 15.0 \quad (11)$$

$$(Ni)+0.5\times((Mn)+(Mo)+(Cu))+30\times(C)\leqq 3.0 \quad (12)$$

$$(Cr)+0.8\times(Mo)-(Mn)-1.7\times(Ni)-27\times(C)-100\times(N)-0.3\times(Cu)\geqq 9.0 \quad (13)$$

where (Cr), (Mo), (Ni), (Mn), (Cu), (Co), (C), and (N) represent Cr, Mo, Ni, Mn, Cu, Co, C, and N contents on a mass percent basis, respectively.

29. The method according to claim 25, wherein the steel slab further comprises at least one of about 0.0050 mass percent or less of B and about 0.0050 mass percent or less of Ca.

30. The method according to claim 26, wherein the steel slab further comprises at least one of about 0.0050 mass percent or less of B and about 0.0050 mass percent or less of Ca.

31. The method according to claim 27, wherein the steel slab further comprises at least one of about 0.0050 mass percent or less, of B and about 0.0050 mass percent or less of Ca.

32. The method according to claim 28, wherein the steel slab further comprises at least one of about 0.0050 mass percent or less of B and about 0.0050 mass percent or less of Ca.

33. The method according to claim 25, wherein the steel slab further comprises at least one component selected from the group consisting of about 0.2 mass percent or less of V, about 0.2 mass percent or less of Zr, and about 0.2 mass percent or less of Ta.

34. The method according to claim 26, wherein the steel slab further comprises at least one component selected from the group consisting of about 0.2 mass percent or less of V, about 0.2 mass percent or less of Zr, and about 0.2 mass percent or less of Ta.

35. The method according to claim 27, wherein the steel slab further comprises at least one component selected from the group consisting of about 0.2 mass percent or less of V, about 0.2 mass percent or less of Zr, and about 0.2 mass percent or less of Ta.

36. The method according to claim 28, wherein the steel slab further comprises at least one component selected from the group consisting of about 0.2 mass percent or less of V, about 0.2 mass percent or less of Zr, and about 0.2 mass percent or less of Ta.

37. The method according to claim 25, wherein the steel slab further comprises at least one of about 0.10 mass percent or less of W and about 0.01 mass percent or less of Mg.

38. The method according to claim 26, wherein the steel slab further comprises at least one of about 0.10 mass percent or less of W and about 0.01 mass percent or less of Mg.

39. The method according to claim 27, wherein the steel slab further comprises at least one of about 0.10 mass percent or less of W and about 0.01 mass percent or less of Mg.

40. The method according to claim 28, wherein the steel slab further comprises at least one of about 0.10 mass percent or less of W and about 0.01 mass percent or less of Mg.

41. The method according to claim 25, wherein the resulting steel sheet has a tensile strength of about 600 MPa or less and is used for welded structural components.

42. The method according to claim 26, wherein the resulting steel sheet has a tensile strength of about 600 MPa or less and is used for welded structural components.

43. The method according to claim 27, wherein the resulting steel sheet has a tensile strength of about 600 MPa or less and is used for welded structural components.

44. The method according to claim 28, wherein the resulting steel sheet has a tensile strength of about 600 MPa or less and is used for welded structural components.

45. The method according to claim 25, further comprising welding steel sheet to produce a welding heat affected zone such that the volume percentage of the martensitic structure produced in the welding heat affected zone of the sheet is less than about 5 percent, and the Charpy impact value of the welding heat affected zone is 30 J/cm$^2$ or more at −50° C.

46. The method according to claim 26, further comprising welding steel sheet to produce a welding heat affected zone such that the volume percentage of the martensitic structure produced in the welding heat affected zone of the sheet is less than about 5 percent, and the Charpy impact value of the welding heat affected zone is 30 J/cm$^2$ or more at −50° C.

47. The method according to claim 27, further comprising welding steel sheet to produce a welding heat affected zone such that the volume percentage of the martensitic structure produced in the welding heat affected zone of the sheet is less than about 5 percent, and the Charpy impact value of the welding heat affected zone is 30 J/cm$^2$ or more at −50° C.

48. The method according to claim 28, further comprising welding steel sheet to produce a welding heat affected zone such that the volume percentage of the martensitic structure produced in the welding heat affected zone of the sheet is less than about 5 percent, and the Charpy impact value of the welding heat affected zone is 30 J/cm$^2$ or more at −50° C.

49. A method for making a cold-rolled steel sheet comprising:

performing a method for making a hot-rolled substantially ferritic steel sheet as set forth in claim 25;

cold-rolling the hot-rolled steel sheet;

annealing the cold-rolled sheet; and pickling the cold-rolled sheet.

50. A method for making a cold-rolled steel sheet comprising:

performing a method for making a hot-rolled substantially ferritic steel sheet as set forth in claim 26;

cold-rolling the hot-rolled steel sheet;

annealing the cold-rolled sheet; and pickling the cold-rolled sheet.

51. A method for making a cold-rolled steel sheet comprising:

performing a method for making a hot-rolled substantially ferritic steel sheet as set forth in claim 27;

cold-rolling the hot-rolled steel sheet;

annealing the cold-rolled sheet; and pickling the cold-rolled sheet.

52. A method for making a cold-rolled steel sheet comprising:

performing a method for making a hot-rolled substantially ferritic steel sheet as set forth in claim 28;

cold-rolling the hot-rolled steel sheet;

annealing the cold-rolled sheet; and pickling the cold-rolled sheet.

* * * * *